US011852138B2

(12) United States Patent
Raleigh

(10) Patent No.: US 11,852,138 B2
(45) **Date of Patent: *Dec. 26, 2023**

(54) FLEXIBLE IMPELLER PUMP FOR FLOWABLE FOOD PRODUCT

(71) Applicant: Server Products, Inc., Richfield, WI (US)

(72) Inventor: Edward Raleigh, Lodi, WI (US)

(73) Assignee: SERVER PRODUCTS, INC., Richfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/357,251

(22) Filed: Jun. 24, 2021

(65) Prior Publication Data

US 2022/0145881 A1 May 12, 2022

Related U.S. Application Data

(63) Continuation of application No. 17/321,900, filed on May 17, 2021.

(Continued)

(51) Int. Cl.
*F04C 15/00* (2006.01)
*F04C 13/00* (2006.01)

(52) U.S. Cl.
CPC ..... *F04C 15/0076* (2013.01); *F04C 13/002* (2013.01); *F04C 15/0038* (2013.01); *F04C 2240/30* (2013.01)

(58) Field of Classification Search
CPC ..... F04C 15/0076; F04C 29/0078; F04C 15/0038; F04C 15/003; F04C 2240/30;

(Continued)

(56) References Cited

U.S. PATENT DOCUMENTS 2,189,356 A 2/1940 Briggs
2,712,792 A 7/1955 Snyder (Continued)

FOREIGN PATENT DOCUMENTS

GB 1059902 A 2/1967
JP S63186981 8/1988

OTHER PUBLICATIONS

International Search Report and Written Opinion for PCT Application No. PCT/US2021/058597, dated Mar. 3, 2022.

*Primary Examiner* — Bryan M Lettman
(74) *Attorney, Agent, or Firm* — Quarles & Brady LLP

(57) ABSTRACT

A flexible impeller pump designed for use in dispensing a flowable food products. The flexible impeller pump includes a cover, impeller assembly and a pump body that are assembled to create the pump without other separate components. The components can be permanently connected to each other to create a disposable pump or can be disassembled for cleaning and reuse. The impeller assembly includes an impeller shaft and a flexible impeller molded over the impeller shaft to prevent separation. The impeller assembly is received within the pump body and the cover is secured to the pump body. The cover includes a seal that is molded over the pump body to prevent separation of the seal from the cover. The impeller shaft extends through the pump body and is coupled to a drive shaft of an electric motor that is operable to drive the impeller pump.

33 Claims, 9 Drawing Sheets

Related U.S. Application Data

(60) Provisional application No. 63/112,423, filed on Nov. 11, 2020.

(58) Field of Classification Search
CPC ..... F04C 13/002; F04C 15/0034; F04C 2/22; F04D 29/12; F04D 29/106; F04D 29/20
See application file for complete search history.

(56) References Cited

U.S. PATENT DOCUMENTS 2,782,723 A 2/1957 Warren et al.
2,933,046 A 4/1960 McCray
3,054,355 A 9/1962 Neely
3,218,983 A 11/1965 Parrett
3,303,791 A * 2/1967 Doble ..... F04C 5/00 418/154
3,901,628 A * 8/1975 Bornholt ..... F04C 14/22 417/310
4,140,444 A * 2/1979 Allen ..... F04C 2/1073 403/334
4,512,720 A 4/1985 Cholakis
5,538,395 A * 7/1996 Hager ..... B29C 66/301 416/144
5,660,536 A * 8/1997 Karls ..... F04C 5/00 418/133
6,394,753 B1 * 5/2002 Maki ..... F04C 2/44 29/267
7,008,187 B2 * 3/2006 Cazzaniga ..... B29C 45/1657 264/271.1
9,719,508 B2 8/2017 Salmela et al.
9,995,296 B2 6/2018 Hayes-Pankhurst et al.
10,465,681 B2 11/2019 Hayes-Pankhurst et al.
10,495,085 B2 12/2019 Hayes-Pankhurst et al.
10,865,805 B2 12/2020 Wegener et al.
10,935,025 B2 3/2021 Hayes-Pankhurst et al.
2007/0148027 A1 * 6/2007 Sommer ..... F01C 21/02 417/566
2009/0041595 A1 2/2009 Garzaniti et al.
2013/0064694 A1 * 3/2013 Kock ..... F04C 29/0042 417/321
2020/0141410 A1 * 5/2020 Kawasaki ..... F04C 19/002

* cited by examiner

FLEXIBLE IMPELLER PUMP FOR FLOWABLE FOOD PRODUCT

CROSS REFERENCE TO RELATED APPLICATIONS

The present application is a continuation of U.S. patent application Ser. No. 17/321,900, filed on May 17, 2021, and is based on and claims priority to U.S. Provisional Patent Application Ser. No. 63/112,423 filed on Nov. 11, 2020, the disclosures of which are incorporated herein by reference.

BACKGROUND

The present disclosure generally relates to a flexible impeller pump for use in pumping flowable food products, such as condiments, from a storage container or bag. More specifically, the present disclosure relates to a flexible impeller pump that includes three separate components that can be easily disassembled for cleaning and reassembled for use or can be disposed of after use.

Flowable food products can include a wide variety of products, such as condiments (i.e. ketchup, mustard, mayonnaise, tartar sauce, etc.), syrups, dressings, cheeses, fudge, caramel or other similar food products that can flow and thus be pumped. Flowable food products can include a wide range of viscosities, non-Newtonian properties, include small particulates and can be dispensed in a wide range of temperatures from cold to hot. Flowable food products can also be heated food products such as liquid cheese or chilled food products.

One of the design objectives of the present disclosure was to develop a pump that was flexible enough in its inherent design to allow for either cleaning and reuse or disposal after use with minimal redesign of the pump. The pump of the present disclosure is designed to have a minimum number of parts to make it as simple as possible for cleaning. Such a design also lends itself to low-cost production if automation and material reduction methods are employed. Depending on material selections to reduce cost (and possibly product life), the pump of the present disclosure can be used as a non-cleanable disposable solution should that be desired for certain applications and food service locations. In such an exemplary embodiment for a disposable pump, it would be likely to mechanically secure the cover to the pump body, such as using ultrasonic welding, making it a permanent assembly.

The present disclosure utilizes a flexible impeller pump that is formed from a reduced number of components such that the pump can be easily assembled and disassembled for cleaning. Further, the components of the flexible impeller pump are molded in a way to prevent separation during assembly and disassembly.

SUMMARY

The present disclosure relates to a flexible impeller pump for use with a flowable food product dispenser. More specifically, the present disclosure is directed to a flexible impeller pump that can be used with a variety of food product dispensers and can be easily disassembled, cleaned and reassembled.

The flexible impeller pump includes three primary components: a pump body, an impeller assembly and a cover. The three components are assembled together and the entire pump assembly can be installed in a food product dispenser and driven by an electric motor to draw a flowable food product through the pump for dispensing as needed.

The pump body includes an inlet port and an outlet port extending from a main body portion. The inlet and outlet ports include barbs for connection to a flexible line for receiving food products or dispensing the food product through an outlet conduit. The barbs on the inlet and outlet ports can also be used to connect the pump body to one of several different fittings. The pump body is molded from a plastic material that can be cleaned and reused.

The impeller assembly of the flexible impeller pump includes an impeller shaft and an over molded flexible impeller portion having a series of impeller vanes. The impeller vanes contact the inner wall of the main body to create suction to draw the flowable food products through the pump body.

The cover of the pump assembly includes a cover member and a seal over molded into the cover member. The seal cannot separate from the cover member such that the seal remains a part of the cover member. The cover is removably attached to the body in an embodiment in which the pump can be cleaned. In a disposable embodiment, the cover would be mechanically secured to the pump body. Such a mechanical connection could be carried out by ultrasonic welding in one exemplary embodiment, although other mechanical connections, such as an FDA approved adhesive, are contemplated.

The pump assembly is designed to be used with a plurality of different fittings. The fittings allow the pump assembly to be used with different supplies of food products, such as food packaging from different food manufacturers. One example of a common food package is a 1.5 gallon Cryovac Pouch with a fitment. In another possible use, the fitment would allow for a direct supply of food product through a tube or line. Another type of fitting can include a valve to prevent dripping of the food product during disconnection of the supply from the pump assembly.

The flexible pump assembly of the present disclosure allows for use with a wide range of dispensers and over a wide range of operating speeds. The elastomeric properties of the impeller vanes allow for a wider variation in tolerances, which allows for the use of molding of the components.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
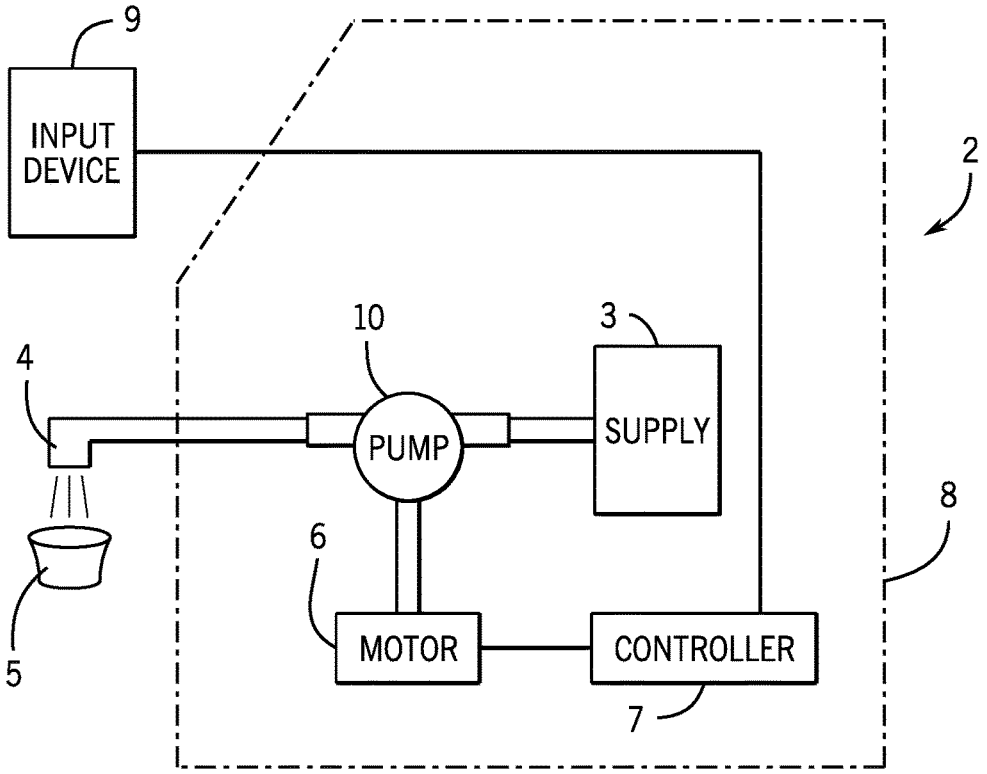
FIG. 1 is a schematic illustration of a food product dispenser including the flexible impeller pump of the present disclosure.

FIG. 1 illustrates a flowable food product dispenser 2 of the present disclosure. In the embodiment shown in FIG. 1, a flowable food product is dispensed from a supply 3 through a spout 4. A container 5 is shown in FIG. 1 as receiving the food product as the food product is dispensed. However, the food product could be dispensed directly onto another food item as desired. The supply of food product could be contained in a flexible bag or package or could be contained directly within a well or open interior of the product dispenser 2. In either case, a flexible impeller pump 10 is connected between the supply 3 and the dispensing spout 4 and is operable to pump the flowable food product out of the food product dispenser as desired.

In the embodiment shown in FIG. 1, the flexible impeller pump 10 is driven by an electric drive motor 6. The drive motor 6 is connected to a supply of electricity, which could be an internal battery or a connection to utility power. The drive motor 6 is preferably a bi-direction electric motor that is operable to drive the flexible impeller pump 10 in either a forward or reverse direction.

The operation of the drive motor 6 is controlled by a controller 7 positioned within the outer housing 8 of the food product dispenser. The controller 7 is operable to control the direction of operation of the drive motor 6, the duration of operation, the speed of operation and any other parameters needed to dispense the desired quantity of food product. In the embodiment shown, the controller 7 is connected to a user input device 9 that allows a user to initiate and control the dispensing of the food product. It is contemplated that the input device 9 could be various different devices. In one exemplary embodiment, the input device 9 can be a touch-free proximity sensor that can detect the presence of a hand of the user. Upon detection, the user input device provides a signal to the controller 7, which can then control the operation of the pump 10. The user input device 9 could also be a touch pad, switch, or any other device that allows a user to indicate that the food product need to be dispensed. The use of a touch-free sensor allows food product to be dispensed without physical contact between the user and any portion of the outer housing 8.

Figure 2:
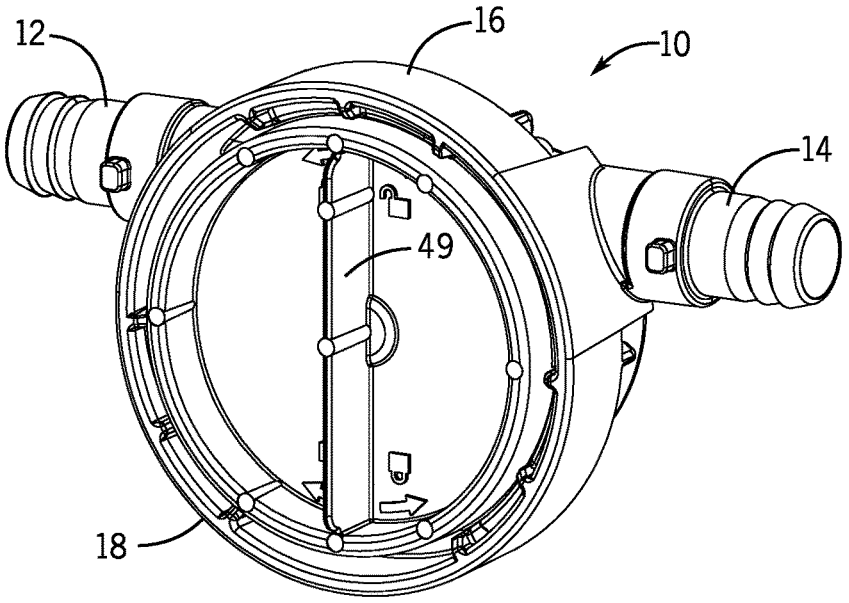
FIG. 2 is a front perspective view of the flexible impeller pump of the present disclosure.

FIG. 2 illustrates the flexible impeller pump 10 constructed in accordance with the present disclosure. The flexible impeller pump 10 is designed for use in a number of installation scenarios, including dispensing flowable food products from a pouch below the counter, direct connection of the pump to a pouch of food product, and integrated into a countertop device with a direct connection to a pouch of food product. In the embodiment shown in FIG. 2, the impeller pump 10 includes an inlet port 12 and an outlet port 14. In the design shown, the impeller pump 10 is reversible such that either of the two ports 12, 14 could be the inlet or the outlet.

In the embodiment shown, the port 12 is designated as the inlet port while the port 14 is designated as the outlet port. The impeller pump 10 includes a pump body 16 that is sized to receive an internal impeller assembly and is enclosed by a cover 18. The impeller pump 10 can be constructed in an embodiment in which the cover 18 can be removed for cleaning or in another embodiment in which the cover 18 is mechanically secured to the pump body 16, such as by ultrasonic welding or adhesives, and the entire pump would be disposable after use.

The impeller is designed to rotate within the pump body 16 to draw food product into the pump body 16 through the inlet port 12 and push the food product out through the outlet port 14.

Figure 3:
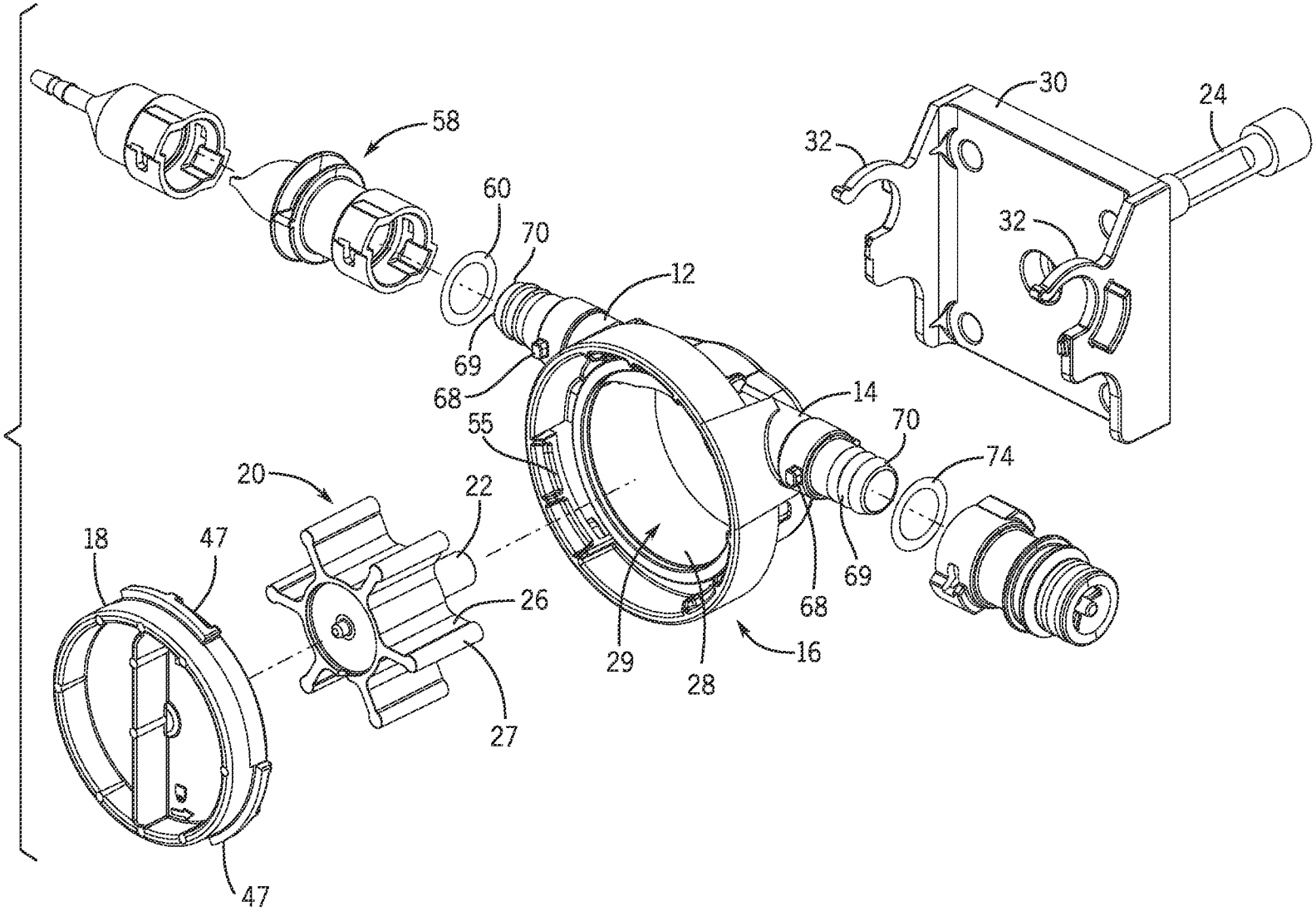
FIG. 3 is an exploded view of the flexible impeller pump.

FIG. 3 is an exploded view of the impeller pump 10 of the present disclosure. As illustrated in FIG. 3, the impeller pump 10 includes the pump body 16, the impeller assembly 20 and the cover 18. The impeller pump 10 was designed to reduce the number of components such that the pump can be easily cleaned after being broken down into the three main components: the body 16, the cover 18 and the impeller assembly 20. In the embodiment illustrated, the pump body 16 is molded from an FDA approved plastic material with a lubrication package. The molded pump body 16 includes an open impeller chamber 29 that is defined by an interior wall 28 and is designed to be dishwasher safe while the lubrication package reduces friction, especially during dry prime when the pump is filled with air and the product must be drawn from a bag or reservoir.

In one exemplary embodiment, the impeller assembly 20 is formed from an FDA approved thermoplastic vulcanizate (TPV) that is formed in an over molding process that creates a chemical bond between the vanes 26 of the impeller and an internal impeller shaft. The two components that form the impeller assembly 20 are chemically and mechanically bonded together to create a single component that will not separate during use and cleaning.

The cover 18 is also formed from an FDA approved plastic with a seal member that is over molded or two-shot molded in place with the main body of the cover 18. Since the seal is permanently attached to the cover, there is no possibility of losing the seal or having the seal being misplaced during cleaning. The seal interacts with the pump body 16 during use to prevent leakage as the rotating impeller assembly 20 moves food product through the pump 10.

As illustrated in FIG. 3, the impeller assembly 20 includes a drive shaft portion 22 that is designed to extend through the pump body 16 and receive and engage a motor shaft 24 of a driving motor. The motor shaft 24 is designed to be rotatable in either direction such that the connected impeller assembly 20 can be rotated to draw material in either direction through the pump body 16. The impeller assembly 20 includes a series of flexible vanes 26 that engage the open interior wall 28 of the valve body. In the embodiment illustrated, each of the vanes 26 is formed from a flexible material that includes an expanded outer edge 27 that creates a seal with the inner wall 28 to draw product in through the inlet port 12 and to push the product out through the outlet port 14.

As further illustrated in FIG. 3, the pump assembly includes a pump retainer bracket 30 that is designed to support the impeller pump 10. The retainer bracket 30 is an injection molded component having a pair of spaced receivers 32 that are spaced from each other to support the pump body 16. In the embodiment shown in FIG. 3, the pump 10 is shown as a configurable pump that can receive a plurality of different types of fittings.

Figure 4A:
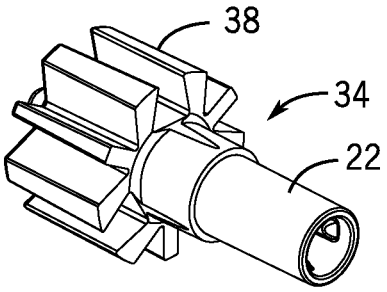
FIG. 4A is a front perspective view of the impeller shaft of the impeller assembly.
Figure 4B:
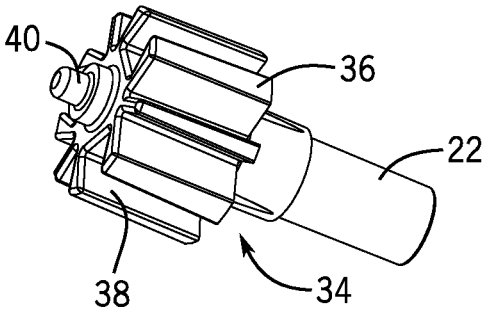
FIG. 4B is a rear perspective view of the impeller shaft.

FIGS. 4A and 4B illustrate an impeller shaft 34 that forms part of the impeller assembly. The impeller shaft 34 is a molded plastic component that includes the drive shaft portion 22 and a splined interface section 36 having a series of individual splines 38. The splines 38 are designed to be able to transmit torque from the electric drive motor to the elastomeric impeller that is molded over the impeller shaft 34. The series of individual splines 38 create a mechanical interface with the elastomeric material that forms the remainder of the impeller assembly as will be described below. The impeller shaft 34 includes a stub shaft 40 that is able to provide rotational support for the end of the impeller shaft opposite the drive shaft portion 22. The drive shaft portion 22 is hollow and designed to engage and receive the motor shaft 24, as previously described, to transmit torque from the stepper motor to the impeller.

Figure 5A:
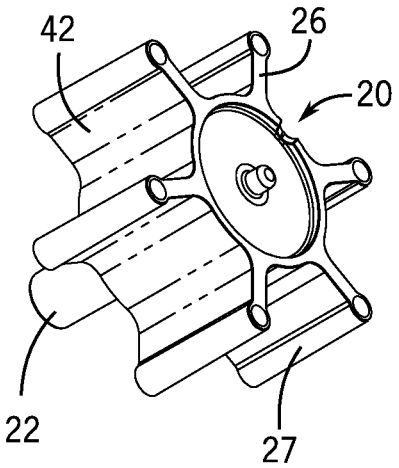
FIG. 5A is a front perspective view of the elastomeric impeller over molded over the impeller shaft.
Figure 5B:
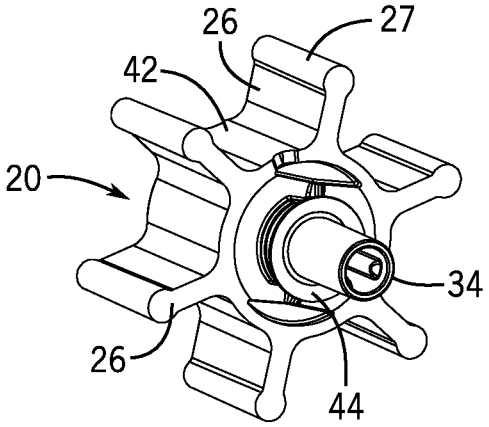
FIG. 5B is a rear perspective view of the elastomeric impeller over molded over the impeller shaft.

FIGS. 5A and 5B illustrate the over molding of the elastomeric impeller portion 42 to the impeller shaft to form the impeller assembly 20. The elastomeric impeller portion 42 includes the plurality of vanes 26. The composite impeller assembly 20 is formed from elastomeric material of the impeller portion 42, such as thermoplastic vulcanizate (TPV), that chemically bonds to the polypropylene impeller shaft 34. In addition to the chemical bond, the mechanical interface created by the series of splines 38 on the impeller shaft 34 also secures the impeller shaft 34 to the over molded impeller portion 42.

Figure 6:
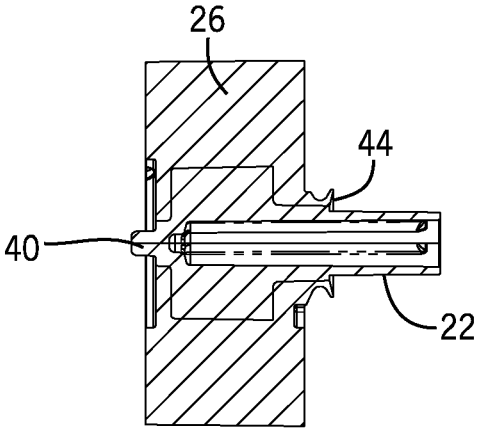
FIG. 6 is a section view of the impeller assembly.

As can be seen in FIGS. 5B and 6, a rear seal 44 is formed as part of the molded impeller portion. The flexible rear seal 44 is designed to create an axial interference fit against the rear face of the pump housing for sealing the drive shaft portion 22. The opposite side of the impeller is supported by the stub shaft 40 and seals against the cover member. When the impeller is inserted into the combination of the cover and body, the impeller vanes 26 flex such that the spring force of the vanes 26 create suction and the desired pumping action during operation.

Figure 7A:
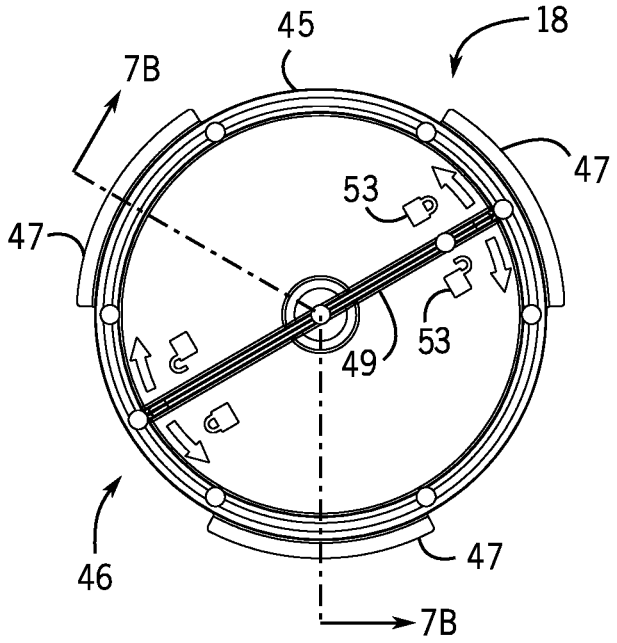
FIG. 7A is a front view of the cover.
Figure 7B:
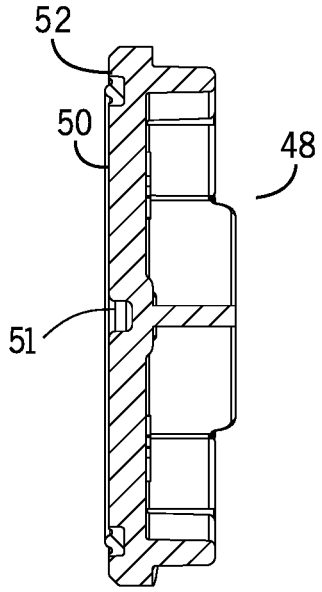
FIG. 7B is a section view of the cover.
Figure 8A:
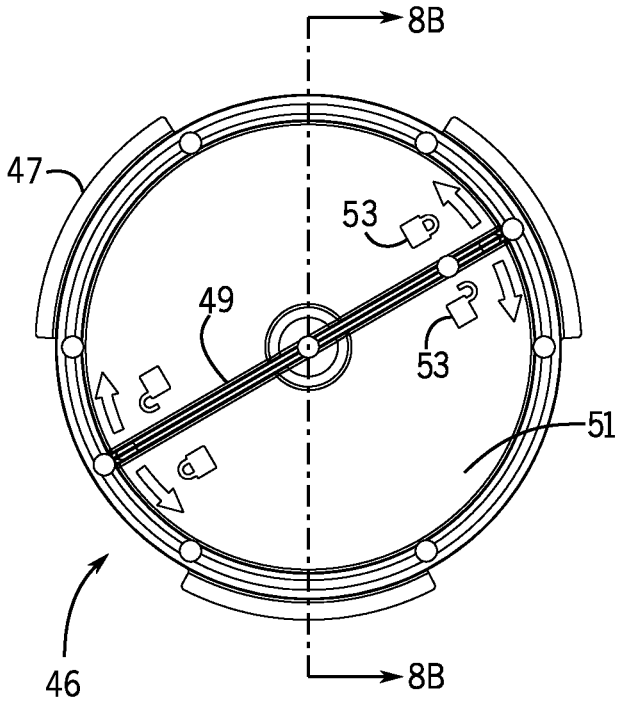
FIG. 8A is a front view of the cover with the seal member co-molded with the cover.
Figure 8B:
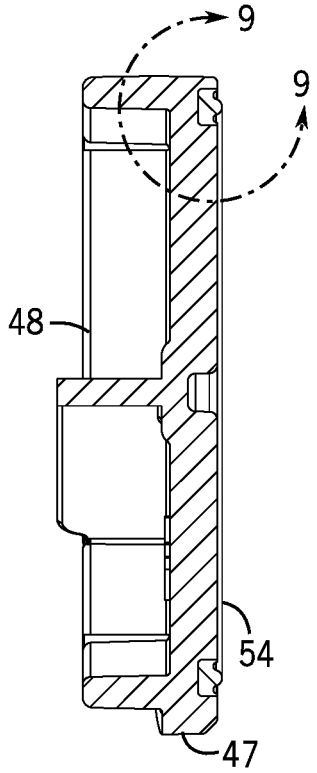
FIG. 8B is a section view of the cover and seal member.

FIGS. 7A and 7B illustrate the main body portion 46 of the cover 18. The cover 18 includes the main body portion 46 having an outer surface 48 and an inner surface 50. The inner surface 50 includes an annular receiving slot 52 that is designed to receive an annular seal and a recessed shaft pocket 51. The main body 46 is formed as a molded rigid plastic part while a seal member 54 is over molded or created in a two-shot molding process after formation of the main body 46 of the cover member. The seal member 54 on the cover is molded from the same TPV material as the impeller portion described previously. The seal member 54 creates a chemical bond with the main body 46 of the cover and remains attached to the cover when the cover is removed from the body of the pump.

The outer edge 45 of the cover member includes a series of locking tabs 47 that are spaced equally around the outer circumference of the cover member 18. The outer surface 48 includes a protruding engagement fin 49 that extends from the otherwise flat face surface 51. The engagement fin 49 allows a point of contact for a user to rotate the entire cover member 18 in either a counterclockwise locking direction or a clockwise unlocking direction as show by the indicators 53 molded into the face surface 51.

When the cover member 18 is installed onto the pump body 16, the locking tabs 47 are received beneath locking projections 55 formed along the inner wall of the pump body 16, as best understood in FIG. 3. The cover member 18 is initially installed such that the locking tabs 47 are spaced from the locking projections 55 and the cover member 18 can then be rotated in the counterclockwise direction until the locking tabs 47 are received beneath the locking projections 55. This engagement holds the cover member in place in an embodiment in which the cover member 18 is designed for removal. When the cover member 18 is installed on the pump body 16, the stub shaft 40 is rotatably supported by the shaft pocket 51 of the cover member 18. The cover member 18 can be released and removed by rotating the cover member 18 in the clockwise direction.

Figure 9:
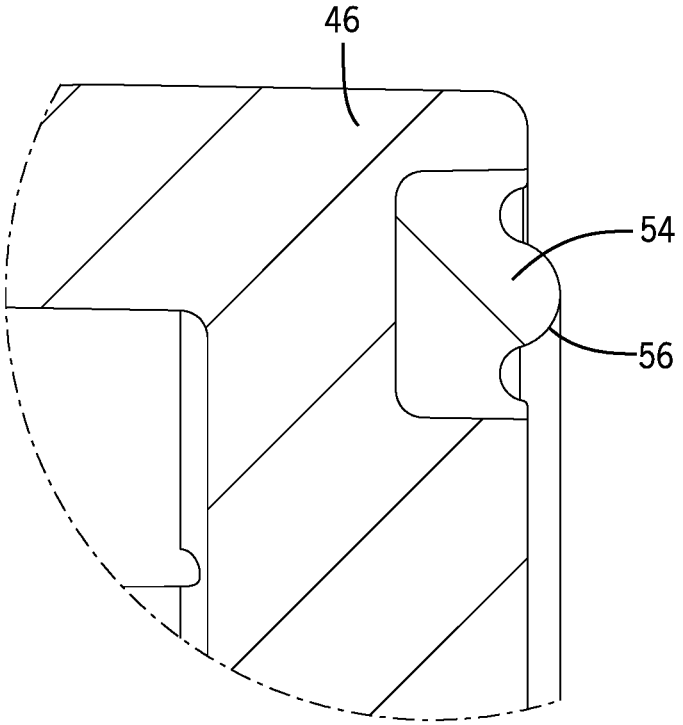
FIG. 9 is a magnified view of the seal member taken along line 9-9 of FIG. 8B.

FIG. 9 provides a magnified view of the seal member 54 formed as part of the co-molding process with the main body portion 46 the cover. The cross section of the seal member 54 includes a protrusion 56 that is designed to engage an inner surface formed in the pump body 16. Since the seal member 54 is co-molded with the remaining portions of the cover, the seal member 54 cannot become lost or disengaged from the cover.

Figure 10:
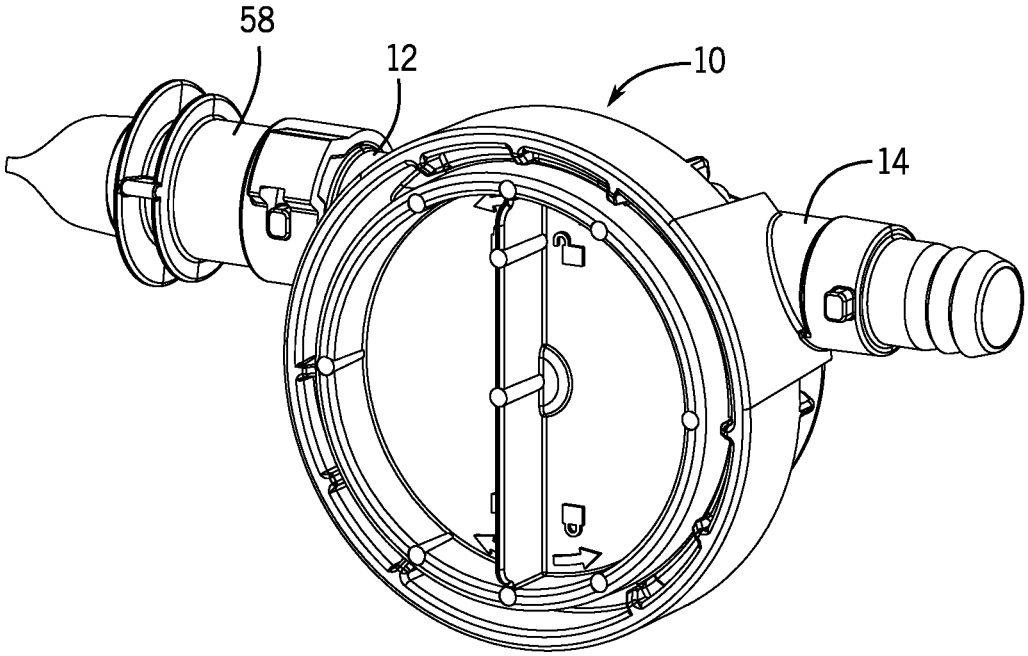
FIG. 10 is a front perspective view of a modification to the pump for use with a Cryovac piercing fitting to connect to a food product pouch.
Figure 11A:
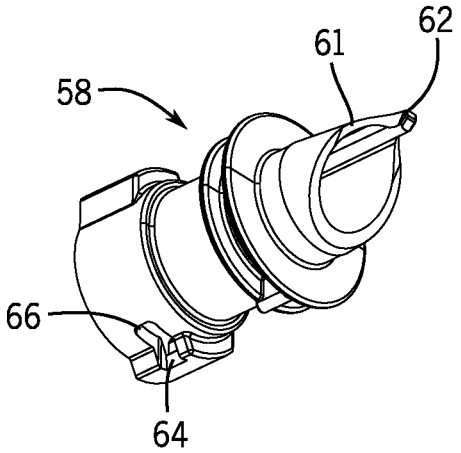
FIG. 11A is a front perspective view of the Cyrovac piercing fitting.
Figure 11B:
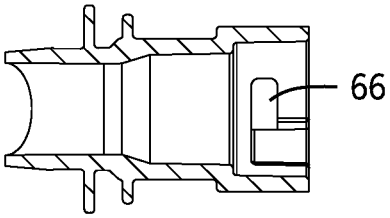
FIG. 11B is a section view of the Cryovac piercing fitting.

FIG. 10 illustrates a first configuration for use of the impeller pump 10 in dispensing flowable food products. In the configuration shown in FIG. 10, a piercing fitting 58 is shown received on the inlet port 12. The piercing fitting 58 is designed to connect directly to a pouch of a flowable food product utilizing a fitting associated with the pouch. As an illustrative example, the food pouch could be a 1.5 gallon Cryovac pouch with the associated fitting. However, it is contemplated that the piercing fitting 58 could be designed to interact with fittings from other manufactures, such as but not limited to VolPak or Scholle. The piercing fitting 58 can be installed on either side of the impeller pump 10. Referring back to FIG. 3, the piercing fitting 58 can include an O-ring 60 or could be utilized without an O-ring depending upon the embodiment. As can be seen in FIG. 11A, the nose 61 of the piercing fitting 58 includes a pointed outer end 62 designed to pierce a pouch that includes the required mating fitting. The piercing fitting 58 further includes a locking collar 64 including an open slot 66 designed to engage a lug 68 formed on the inlet port 12. A similar lug 68 is included on the outlet port 14. The lugs 68 provide a point of attachment for a locking mechanism to receive one of the fittings as will be described.

As can be understood in FIG. 3, the nose 69 of the inlet port 12 and the outlet port 14 each include a barbed fitting portion 70 that allows the inlet port 12 to securely engage the piercing fitting 58. Likewise, the outlet port 14 includes a similar barbed fitting 70 that allows a fitting to be received on the outlet port 14.

The associated geometry in all of the fittings is designed to be fully encapsulating to reduce creep and to enhance strength. The compression on the conical nose 69 of the pump body is controlled by accurately locating the surface in the shutoff.

Figure 12:
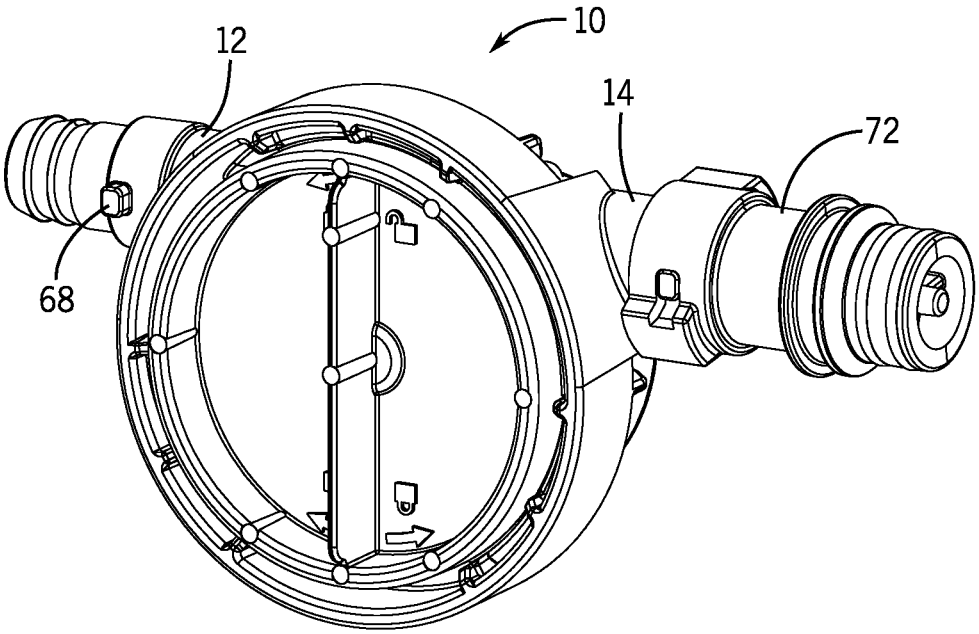
FIG. 12 is a front perspective view of a second modification to the pump for use with an integral shut off valve.

FIG. 12 illustrates another embodiment for using the impeller pump 10 of the present disclosure. In this embodiment, the outlet port 14 is shown receiving a shutoff fitting 72. The shutoff fitting 72 is also shown in the embodiment of FIG. 3.

Figure 13A:
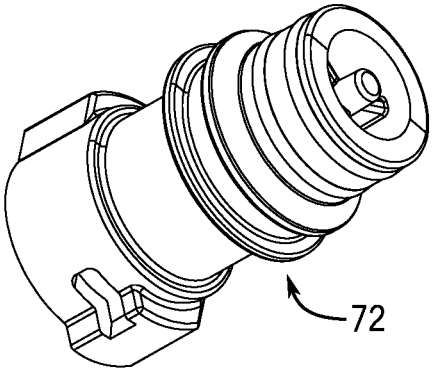
FIG. 13A is a front perspective view of the shut off valve.
Figure 13B:
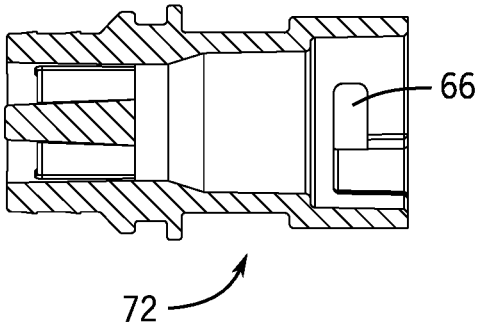
FIG. 13B is a section view of the shut off valve.
Figure 14:
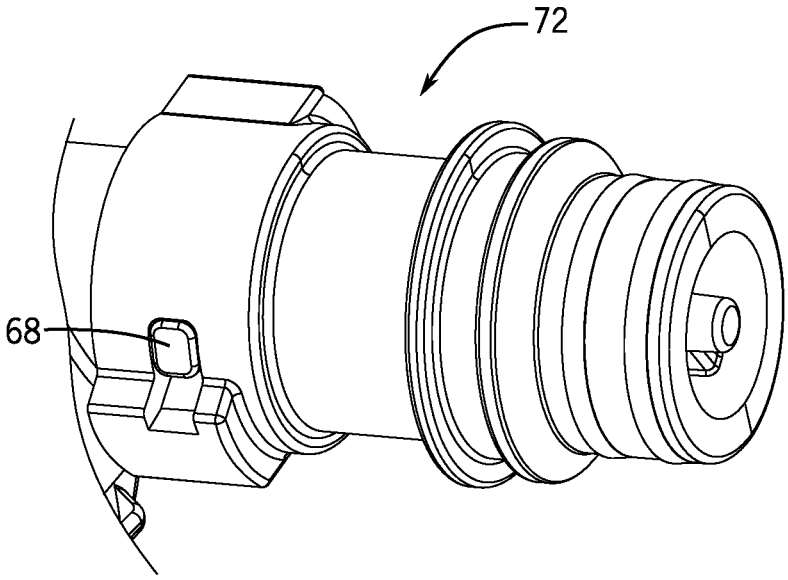
FIG. 14 is a magnified view of the interaction between the shut off valve and the flexible impeller pump.
Figure 15:
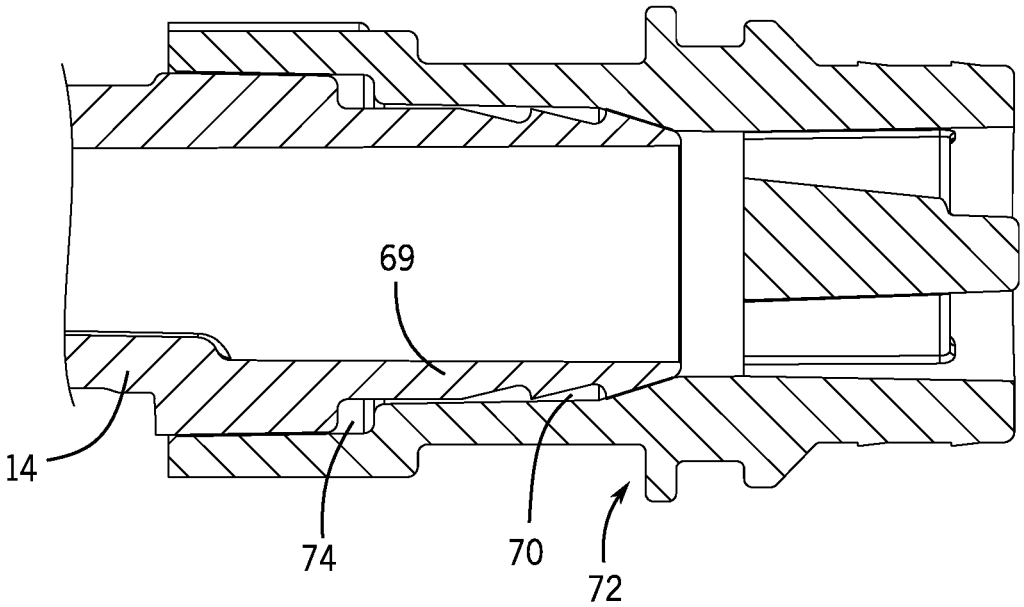
FIG. 15 is a section view of the interaction shown in FIG. 14.

The shutoff fitting 72 is designed such that food product lines can be connected and disconnected from the pump 10 without food product leaking. In the embodiment shown in FIGS. 3 and 15, an O-ring 74 is utilized with the shutoff fitting 72, although the O-ring 74 could be eliminated. FIGS. 13A and 13B, along with FIG. 13, show additional views of the shutoff fitting 72. As with the piercing fitting, the shutoff fitting 72 engages the lug 68 formed as part of the valve body to securely hold the shutoff fitting 72 in place and provide for proper alignment.

Figure 16:
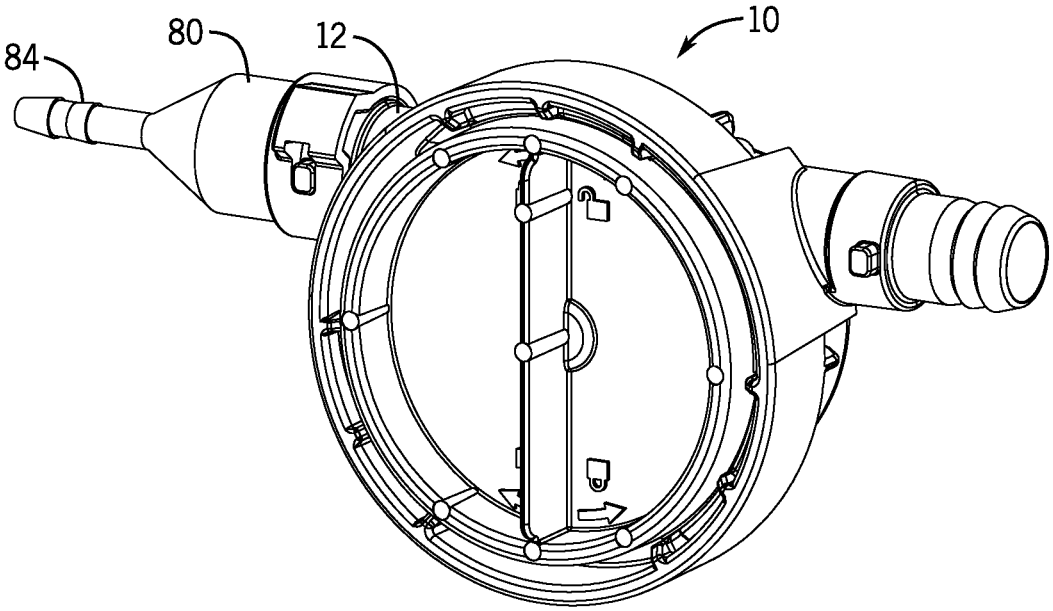
FIG. 16 is a front perspective view of a third modification to the pump for use with a barbed line reducer.

FIG. 16 illustrates yet another contemplated embodiment for using the impeller pump 10. In the embodiment shown in FIG. 16, a barbed line-reducer fitting 80 is shown connected to the inlet port 12. The barbed line-reducer fitting 80 is used to reduce the size of the inlet fitting from the original size to a small, one-eighth inch diameter outlet fitting 84. Such barbed line-reducer fitting 80 allows for use with a low-viscosity, small-dosing application wherein the transition to a small diameter line is advantageous. The line-reducer fitting 80 can be implemented on either side of the pump 10.

Figure 17:
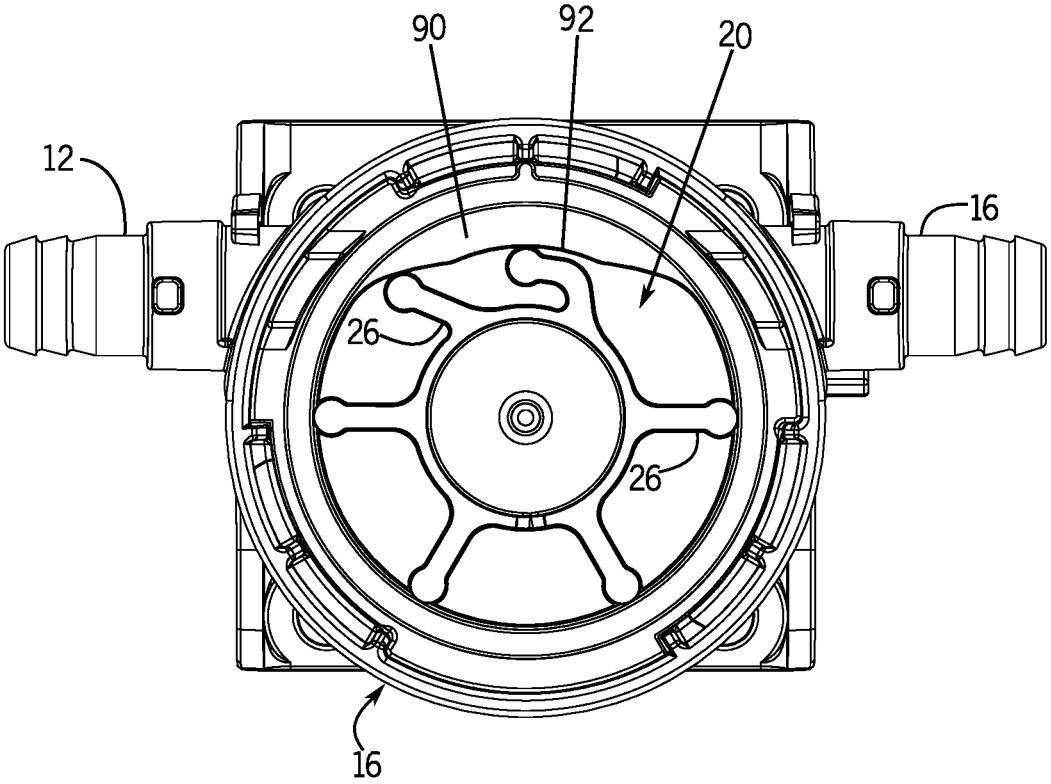
FIG. 17 is a front view of the impeller assembly installed in the pump body.

FIG. 17 is a front view showing the installation of the impeller assembly 20 within the pump body 16 and the operation of the flexible vanes 26 to draw liquid food product from the inlet port 12 to the outlet port 16. As illustrated, the inner wall of the pump body 16 includes a ramp portion 90 that extends into the open interior of the pump body. The ramp portion 90 includes a cam surface 92 that induces bending in the impeller vanes 26 as the impeller vanes 26 rotate along the cam surface 92. The interaction between the impeller vanes 26 and the cam surface 92 creates a suction that draws the liquid fluid product into the inlet port 12 and forces the liquid food product out of the outlet port 16.

As can be understood by the above description, the flexible impeller pump of the present disclosure creates a flexible impeller that is inherently easier to seal due to the elastomeric properties of the impeller. By comparison to other types of pumps, such as a gear pump or a vane pump, the flexible impeller pump of the present disclosure creates sealing that can be accomplished with interference fits that are within the process capabilities of injection molding. Further, the injection molding process can bond the flexible impeller to the rigid drive shaft to accomplish a reduction in the number of separate parts to be handled during cleaning. The flexible impeller pump of the present disclosure can operate over a wide variety of speeds and, due to the inherent elastomeric properties, generally exhibits less pump slip at low speeds compared to gear or vane pumps.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A three piece pump assembly operable to pump a flowable food product, comprising:

a pump body comprising an inlet port, an outlet port and an open impeller chamber, wherein the inlet port and the outlet port are in direct fluid communication with the open impeller chamber;

an impeller assembly configured to be received within the open impeller chamber, the impeller assembly comprising an impeller shaft extending between a drive shaft portion and a stub shaft formed on an opposite end of the impeller shaft and an impeller portion having a plurality of vanes, wherein the impeller portion is molded over an interface section of the impeller shaft to prevent separation of the impeller portion and the impeller shaft; and a cover member further comprising:

a body, wherein an outer surface thereof includes a protruding engagement fin configured as a point of contact for a user to rotate the cover member in a counterclockwise locking direction or a clockwise unlocking direction, and a seal member integral with the body to prevent separation of the seal member from the body, wherein the cover member is configured to be received and retained on the pump body such that the cover member rotatably supports the stub shaft of the impeller shaft and the seal member is positioned in direct contact with the body of the cover member and the pump body to create a seal between the pump body and the cover member.

2. The pump assembly of claim 1 wherein the interface section includes a plurality of splines that frictionally engage the impeller portion.

3. The pump assembly of claim 1 wherein the impeller shaft is formed from molded plastic and the impeller portion is formed from an elastomeric material.

4. The pump assembly of claim 1 wherein the cover member is mechanically secured to the pump body to retain the impeller assembly within the impeller chamber.

5. The pump assembly of claim 4 wherein the cover member is ultrasonically welded to the pump body.

6. The pump assembly of claim 1 wherein the body of the cover member includes an annular receiving slot on an inner surface of the body, wherein the seal member is received and retained within the annular receiving slot.

7. The pump assembly of claim 6 wherein the seal member is molded within the annular receiving slot.

8. The pump assembly of claim 1 wherein the drive shaft portion extends from the pump body for engagement with a drive motor.

9. The pump assembly of claim 1 wherein the outer surface of the body of the cover member includes a plurality of indicators molded into the outer surface configured to indicate the locking direction and the unlocking direction.

10. The pump assembly of claim 1 wherein the pump body further includes a plurality of locking projections formed and equally spaced along an inner wall of the pump body configured to engage the cover member.

11. The pump assembly of claim 10 wherein the cover member further includes a plurality of locking tabs that are equally spaced around the outer circumference of the cover member and configured to be received beneath the locking projections.

12. A pump operable to pump a flowable food product, comprising:

a pump body including an inlet port, an outlet port and an open impeller chamber;

an impeller assembly configured to be received within the open impeller chamber, the impeller assembly including an impeller shaft and an impeller portion having a plurality of vanes; and a cover member having:

a body, wherein an outer surface thereof includes a protruding engagement fin configured as a point of contact for a user to rotate the cover member in a counterclockwise locking direction or a clockwise unlocking direction, and a seal member integral with the body, wherein the cover member is configured to be received and retained on the pump body such that the seal member is positioned between the body of the cover member and the pump body;

wherein the impeller portion includes a rear seal formed as an integral part of the impeller portion along with the plurality of vanes and located in the impeller chamber, wherein the rear seal is axially spaced from the plurality of vanes and surrounds the impeller shaft and contacts a rear face of the pump body to create a seal with the rear face around the impeller shaft when the impeller assembly is received in the pump body.

13. The pump of claim 12 wherein the outer surface of the body of the cover member includes a plurality of indicators molded into the outer surface configured to indicate the locking direction and unlocking direction.

14. The pump of claim 12 wherein the pump body further includes a plurality of locking projections formed and equally spaced along an inner wall of the pump body configured to engage the cover member.

15. The pump of claim 14 wherein the cover member includes a plurality of locking tabs that are equally spaced around the outer circumference of the cover member and configured to be received beneath the locking projections.

16. A flowable food product dispenser for dispensing a flowable food product from a supply of the flowable food product, comprising:

a three piece pump assembly operable to pump the flowable food product out of the dispenser; and a drive motor coupled to the pump and operable to rotate the three piece pump assembly, wherein the three piece pump assembly consists of:

a pump body comprising an inlet port, an outlet port and an open impeller chamber, wherein the inlet port and the outlet port are in direct fluid communication with the open impeller chamber;

an impeller assembly configured to be received within the open impeller chamber, the impeller assembly comprising an impeller shaft extending between a drive shaft portion and a stub shaft formed on an opposite end of the impeller shaft and an impeller portion having a plurality of vanes, wherein the impeller portion is molded over an interface section of the impeller shaft to prevent separation of the impeller portion and the impeller shaft; and a cover member comprising:

a body, wherein an outer surface thereof includes a protruding engagement fin configured as a point of contact for a user to rotate the cover member in a counterclockwise locking direction or a clockwise unlocking direction, and a seal member integral with the body to prevent separation of the seal member from the body, wherein the cover member is configured to be received and retained on the pump body such that the cover member rotatably supports the stub shaft of the impeller shaft and the seal member is positioned in direct contact with the body of the cover member and the pump body to create a seal between the pump body and the cover member.

17. The food product dispenser of claim 16 wherein the interface section includes a plurality of splines that frictionally engage the impeller portion.

18. The food product dispenser of claim 16 wherein the impeller shaft is formed from molded plastic and the impeller portion is formed from an elastomeric material.

19. The food product dispenser of claim 16 wherein the cover member is mechanically secured to the pump body to retain the impeller assembly within the impeller chamber.

20. The food product dispenser of claim 16 wherein the cover member includes an annular receiving slot on an inner surface of the body, wherein the seal member is received and retained within the annular receiving slot.

21. The food product dispenser claim 20 wherein the seal member is molded within the annular receiving slot.

22. The food product dispenser of claim 16 wherein the drive shaft portion extends from the pump body for engagement with a drive motor.

23. The food product dispenser of claim 16 wherein the outer surface of the body of the cover member includes a plurality of indicators molded into the outer surface configured to indicate the locking direction and unlocking direction.

24. The food product dispenser of claim 16 wherein the pump body further includes a plurality of locking projections formed and equally spaced along an inner wall of the pump body configured to engage the cover member.

25. The food product dispenser of claim 24 wherein the cover member includes a plurality of locking tabs that are equally spaced around the outer circumference of the cover member and configured to be received beneath the locking projections.

26. A flowable food product dispenser for dispensing a flowable food product from a supply of the flowable food product, comprising:

a three piece pump assembly operable to pump the flowable food product out of the dispenser; and a drive motor coupled to the three piece pump assembly and operable to rotate the pump, wherein the three piece pump assembly consists of:

a pump body including an inlet port, an outlet port and an open impeller chamber;

an impeller assembly configured to be received within the open impeller chamber, the impeller assembly including an impeller shaft and an impeller portion having a plurality of vanes; and a cover member comprising:

a body, wherein an outer surface thereof includes a protruding engagement fin configured as a point of contact for a user to rotate the cover member in a counterclockwise locking direction or a clockwise unlocking direction, and a seal member integral with the body, wherein the cover member is configured to be received and retained on the pump body such that the seal member is positioned between the body of the cover member and the pump body, wherein the impeller portion includes a rear seal is formed as an integral part of the impeller portion along with the plurality of impeller vanes and located in the impeller chamber, wherein the rear seal is axially spaced from the plurality of vanes and surrounds the impeller shaft and contacts a rear face of the pump body to create a seal with the rear face of the pump body around the impeller shaft when the impeller assembly is received in the pump body.

27. The flowable food product dispenser of claim 26 wherein the outer surface of the body of the cover member includes a plurality of indicators molded into the outer surface configured to indicate the locking direction and unlocking direction.

28. The flowable food product dispenser of claim 26 wherein the pump body further includes a plurality of locking projections formed and equally spaced along an inner wall of the pump body configured to engage the cover member.

29. The flowable food product dispenser of claim 28 wherein the cover member includes a plurality of locking tabs that are equally spaced around the outer circumference of the cover member and configured to be received beneath the locking projections.

30. A three piece pump assembly for use in a food product dispenser to pump a flowable food product, comprising:

a pump body comprising an inlet port, an outlet port and an open impeller chamber, wherein the inlet port and the outlet port are in direct fluid communication with the open impeller chamber;

an impeller assembly configured to be received within the open impeller chamber, the impeller assembly comprising an impeller shaft extending between a drive shaft portion and a stub shaft formed on an opposite end of the impeller shaft and an impeller portion having a plurality of vanes, wherein the impeller portion is molded over an interface section of the impeller shaft to prevent separation of the impeller portion and the impeller shaft; and a cover member comprising:

a body, wherein an outer surface thereof includes a protruding engagement fin configured as a point of contact for a user to rotate the cover member in a counterclockwise locking direction or a clockwise unlocking direction, and a seal member molded into the body such that the seal member is integral with the body of the cover member to prevent separation of the seal member from the body, wherein the cover member is configured to be received and retained on the pump body such that the cover member rotatably supports the stub shaft of the impeller shaft and the seal member is positioned in direct contact with the body of the cover member and the pump body to create a seal between the pump body and the cover member.

31. The pump assembly of claim 30 wherein the outer surface of the body of the cover member includes a plurality of indicators molded into the outer surface configured to indicate the locking direction and unlocking direction.

32. The pump assembly of claim 30 wherein the pump body further includes a plurality of locking projections formed and equally spaced along an inner wall of the pump body configured to engage the cover member.

33. The pump assembly of claim 32 wherein the cover member includes a plurality of locking tabs that are equally spaced around the outer circumference of the cover member and configured to be received beneath the locking projections.

* * * * *